US011095035B2

(12) United States Patent
Klein et al.

(10) Patent No.: US 11,095,035 B2
(45) Date of Patent: Aug. 17, 2021

(54) BROAD BAND DIPOLE ANTENNA

(71) Applicant: AEROANTENNA TECHNOLOGY, INC., Chatsworth, CA (US)

(72) Inventors: Joseph Klein, Chatsworth, CA (US); Vladimir Kimelblat, Chatsworth, CA (US)

(73) Assignee: AEROANTENNA TECHNOLOGY, INC., Chatsworth, CA (US)

( * ) Notice: Subject to any disclaimer, the term of this patent is extended or adjusted under 35 U.S.C. 154(b) by 87 days.

(21) Appl. No.: 16/275,653

(22) Filed: Feb. 14, 2019

(65) Prior Publication Data

US 2020/0266545 A1 Aug. 20, 2020

(51) Int. Cl.

| | |
|---|---|
| ***H01Q 9/28*** | (2006.01) |
| ***H01Q 1/52*** | (2006.01) |
| ***H01Q 1/38*** | (2006.01) |

(52) U.S. Cl.

CPC ..... *H01Q 9/285* (2013.01); *H01Q 1/38* (2013.01); *H01Q 1/52* (2013.01)

(58) Field of Classification Search

None

See application file for complete search history.

(56) References Cited

U.S. PATENT DOCUMENTS

| | | | | |
|---|---|---|---|---|
| 5,367,312 | A | 11/1994 | Masters | |
| 5,872,546 | A | 2/1999 | Ihara et al. | |
| 6,590,545 | B2 | 7/2003 | McCorkle | |
| 7,209,089 | B2 * | 4/2007 | Schantz ..... | H01Q 13/10 343/787 |

(Continued)

FOREIGN PATENT DOCUMENTS

| | | |
|---|---|---|
| EP | 1249893 B1 | 12/2004 |

OTHER PUBLICATIONS

Taylor, R.M., Abstract of "A Broadband Omnidirectional Antenna," Proceedings of IEEE Antennas ad Propagation Society International Symposium and URSI National Radio Science Meeting, Jun. 20-24, 1994, all enclosed pages cited.

*Primary Examiner* — Amy Cohen Johnson

*Assistant Examiner* — James H Cho

(74) *Attorney, Agent, or Firm* — Burr & Forman, LLP

(57) ABSTRACT

A broad band dipole antenna includes a first top radiator which is a planar polygonal shaped surface arranged parallel to vertical axis of the broad band dipole antenna, a first bottom radiator which is a planar polygonal shaped surface arranged parallel to the first radiator and below of the first top radiator, a first coupler which is a planar polygonal shaped surface arranged in close proximity to both the first top radiator and the first bottom radiator, N−1 top radiators where each next top radiator is a copy of the previous top radiator which is rotated by approximately 360°/N around the vertical axis, where N is an integer greater than one, N−1 bottom radiators where each next bottom radiator is a copy of the previous bottom radiator which is rotated by approximately 360'/N around the vertical axis, N−1 couplers where each next coupler is a copy of the previous coupler which is rotated by approximately 360'/N around the vertical axis, a first jumper which connects bottom sides of all the top radiators, and a second jumper which connects top sides of all the bottom radiators.

8 Claims, 13 Drawing Sheets

(56) References Cited

U.S. PATENT DOCUMENTS

| | | | | |
|---|---|---|---|---|
| 7,679,575 | B1 * | 3/2010 | Horner | H01Q 13/085 343/770 |
| 8,780,001 | B2 * | 7/2014 | Lee | H01Q 5/48 343/818 |
| 9,590,310 | B1 * | 3/2017 | Barts | H01Q 1/38 |
| 2003/0046042 | A1 | 3/2003 | Butler et al. | |
| 2006/0022876 | A1 * | 2/2006 | Sonoda | H01Q 9/28 343/700 MS |
| 2016/0365641 | A1 * | 12/2016 | Mayer | H01Q 1/50 |

* cited by examiner

BROAD BAND DIPOLE ANTENNA

TECHNICAL FIELD

Example embodiments generally relate to antennas and, in particular, relate to a broad band dipole antenna.

BACKGROUND

As wireless communication devices continue to proliferate, there continues to be a need for broad band antennas that cover the increasing needs for additional frequency bands. It is also important to find solutions to use small antennas that do not require a large amount of space. The use of a ground plane can help solve the problem of a broad band high efficiency antenna as the ground plane can reduce and mask the current flows on the lines feeding the antenna. The use of a ground plane below the radiator, which because of the ground plane becomes a monopole or half of a dipole, can typically enable feeding by coaxial lines. When fed or excited by coaxial lines that by design mask the current flow, effects on the monopole radiation and performance can be minimized. Thus, it may be desirable to develop new antenna designs that make advantageous use of a ground plane and improve performance.

BRIEF SUMMARY OF SOME EXAMPLES

In some example embodiments, an antenna design is presented for a dipole antenna that has broad band coverage, for example, in the range of 0.7 GHz to 2.7 GHz. The antenna design is configured to perform as a theoretical dipole, i.e., having a balanced radiation pattern very close to a torus shape, gain as close as possible to 2.2 dBi, and reflected power as low as possible to facilitate high efficiency and minimize the current flow on the feed line that a dipole case cannot be reduced by the assistance of a ground plane.

In an example embodiment, broad band dipole antenna includes a first top radiator which is a planar polygonal shaped surface arranged parallel to vertical axis of the broad band dipole antenna, a first bottom radiator which is a planar polygonal shaped surface arranged parallel to the first radiator and below of the first top radiator, a first coupler which is a planar polygonal shaped surface arranged in close proximity to both the first top radiator and the first bottom radiator, N−1 top radiators where each next top radiator is a copy of the previous top radiator which is rotated by approximately 360°/N around the vertical axis, where N is an integer greater than one, N−1 bottom radiators where each next bottom radiator is a copy of the previous bottom radiator which is rotated by approximately 360'/N around the vertical axis, N−1 couplers where each next coupler is a copy of the previous coupler which is rotated by approximately 360'/N around the vertical axis, a first jumper which connects bottom sides of all the top radiators, and a second jumper which connects top sides of all the bottom radiators.

In another example embodiment, a Balun is formed to a compact structure formed by bending a coaxial cable to a loop divided into two equal (or unequal) length segments with an isolating gap between the two segments.

BRIEF DESCRIPTION OF THE SEVERAL VIEWS OF THE DRAWING(S)

Having thus described some example embodiments in general terms, reference will now be made to the accompanying drawings, which are not necessarily drawn to scale, and wherein:

Figure 15:
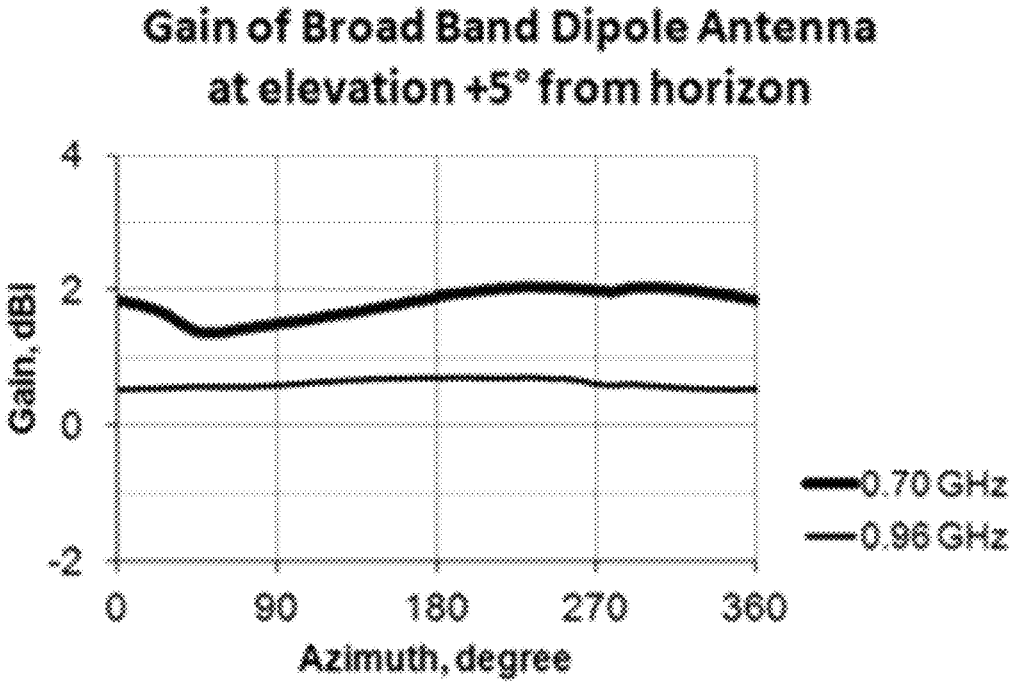
Figure 16:
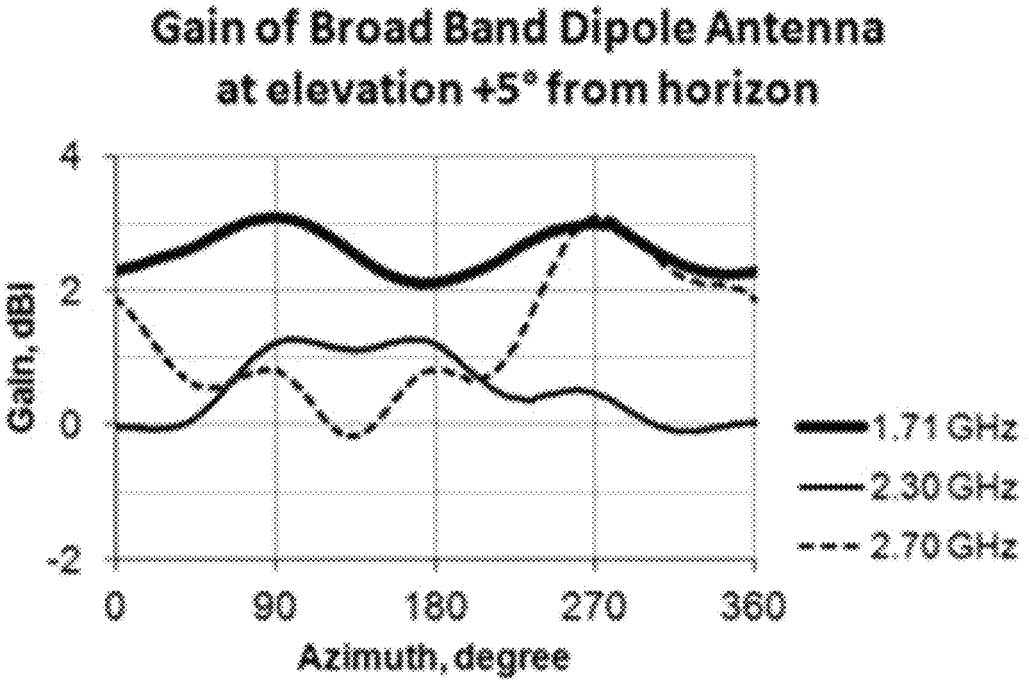

FIG. 15 illustrates a plot of the radiation pattern of gain at 5 degrees elevation versus azimuth at frequencies 0.70 and 0.96 GHz of the broad band dipole antenna of an example embodiment; and FIG. 16 illustrates a plot of the radiation pattern of gain at 5 degrees elevation versus azimuth at frequencies 1.71, 2.3 and 2.7 GHz of the broad band dipole antenna of an example embodiment.

DETAILED DESCRIPTION

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

Figure 1:
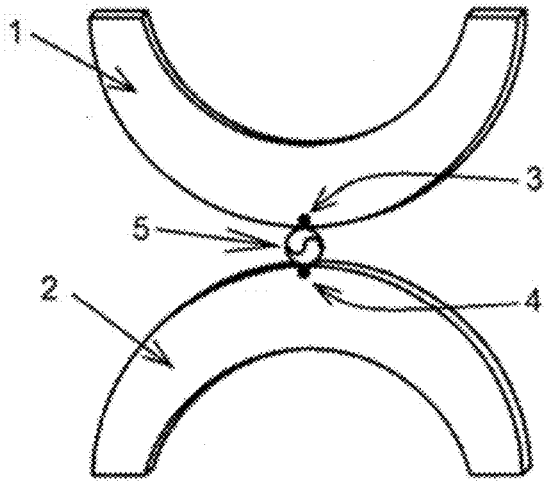
FIG. 1 PRIOR ART
FIG. 1 illustrates a simple conceptual dipole antenna.
Figure 2:
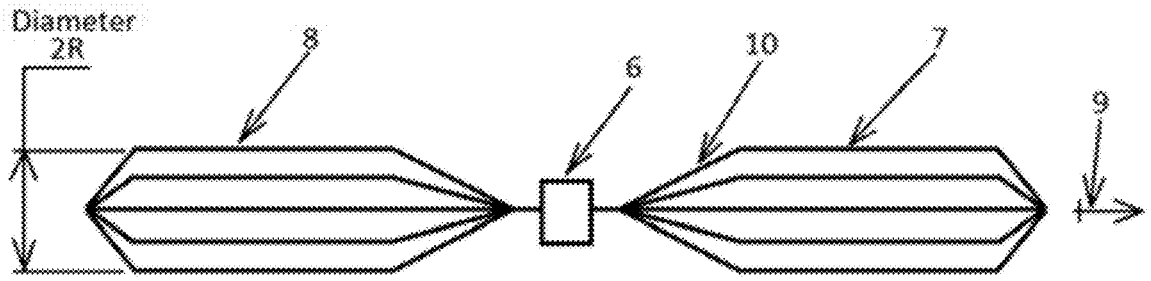
FIG. 2 PRIOR ART
FIG. 2 illustrates a dipole antenna showing a broad band dipole achieved by increasing volume of the antennas in this case using wire-lines that can help at lower frequencies.
Figure 3:
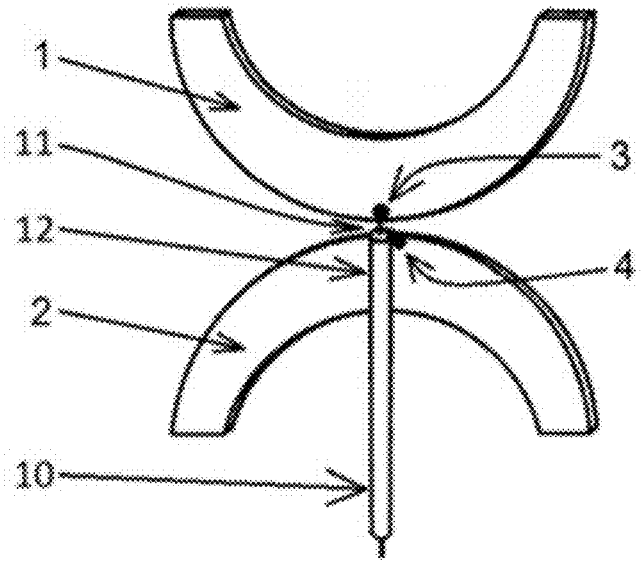
FIG. 3 PRIOR ART
FIG. 3 illustrates a dipole antenna fed without suppressing the current on the coaxial feed.
Figure 4:
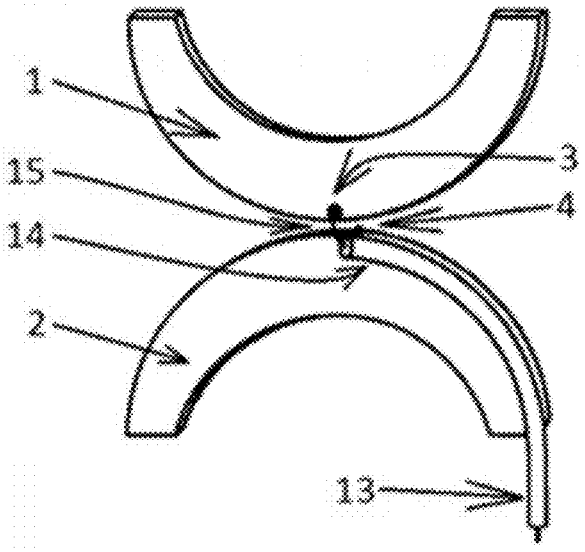
FIG. 4 PRIOR ART
FIG. 4 illustrates a dipole antenna similar to the above feed and not adding any degrees of freedom to control the design.
Figure 5:
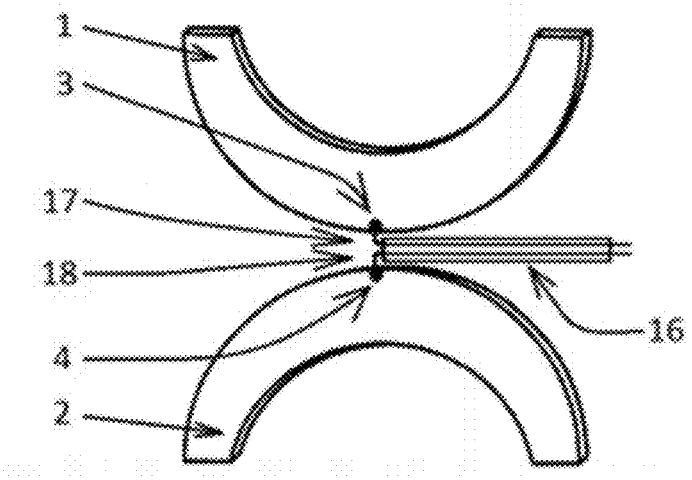
FIG. 5 PRIOR ART
FIG. 5 illustrates a dipole antenna employing a feed method that results in distortion of the radiation patterns.

FIGS. 1-5 illustrate various prior art radiators of broad band dipoles having a closed plane figure bounded mostly by a circular or elliptic line. FIG. 1 is a perspective view illustrating the antenna structure that comprises a pair of substantially semicircular arcwise radiators 1 and 2 (made of copper or aluminum, for instance). The outer and inner marginal edges of each arcwise radiator 1 may be semicircular or semi-elliptic. The two radiators 1 and 2 are disposed with vertexes 3 and 4 of their circular arcs opposed to each other and a feeding section 5 is provided between the vertexes 3 and 4. As shown in FIG. 3, a coaxial cable 10 may be disposed along the centerline of the radiator 2. However, the coaxial cable 10 could alternatively extend along the arc of the radiator 2 as shown by cable 13 in FIG. 4. FIG. 5 shows a twin-lead type feeder. Using only a radius of circle or ellipse to form the radiators limits the design bandwidth and performance by use of complex shapes to control of electrical parameters to achieve larger frequency bandwidths higher efficiency and classical theoretical dipole performance. In addition, the known methods for feeding the antennas of FIGS. 1-5 do not solve a significant problem in dipole antennas and that is that the feed lines radiate and distort the performance and reduce the efficiency of the antenna.

Figure 6:
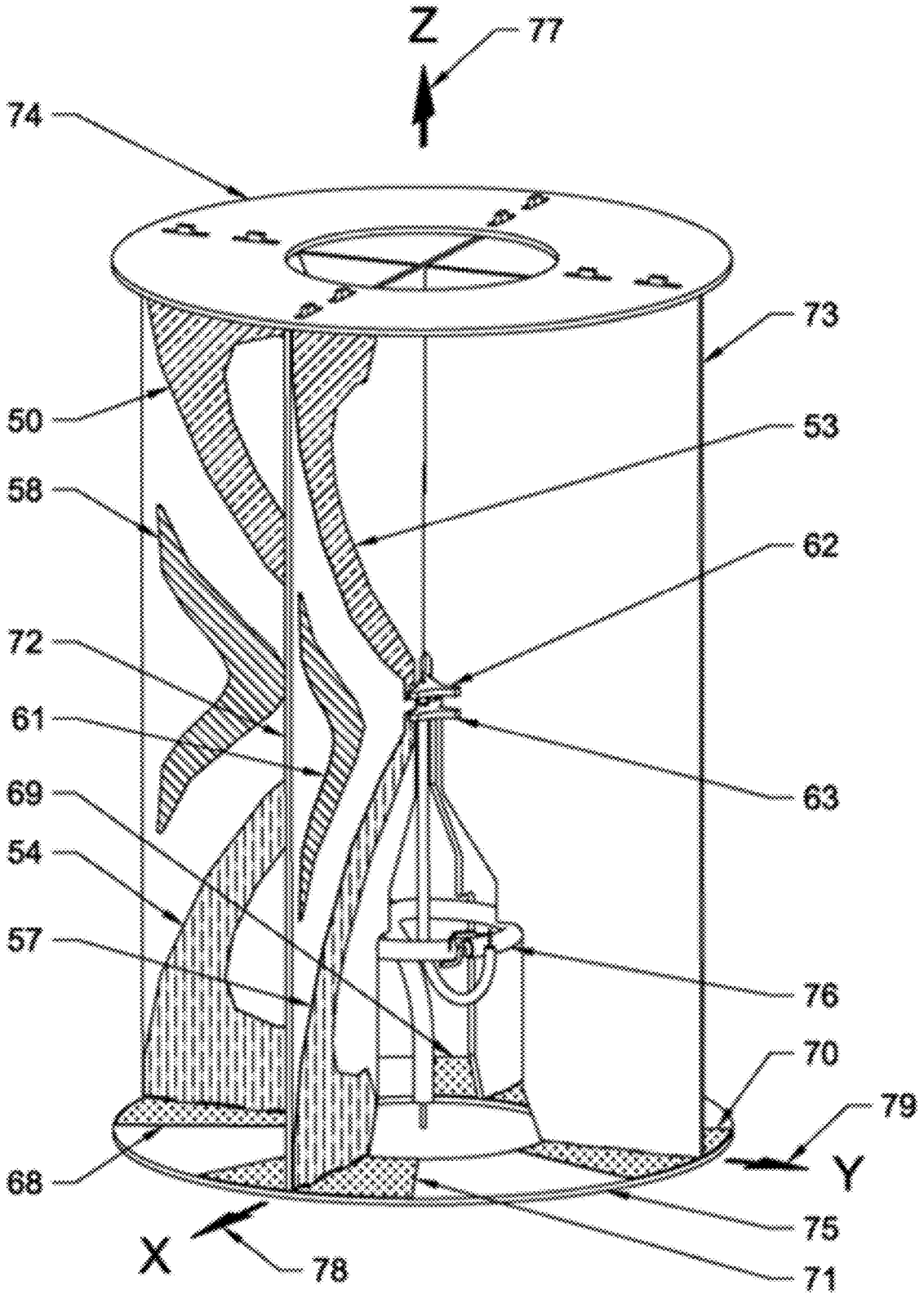
FIG. 6 illustrates isometric view from a side perspective of a broad band dipole antenna in accordance with an example embodiment.
Figure 7:
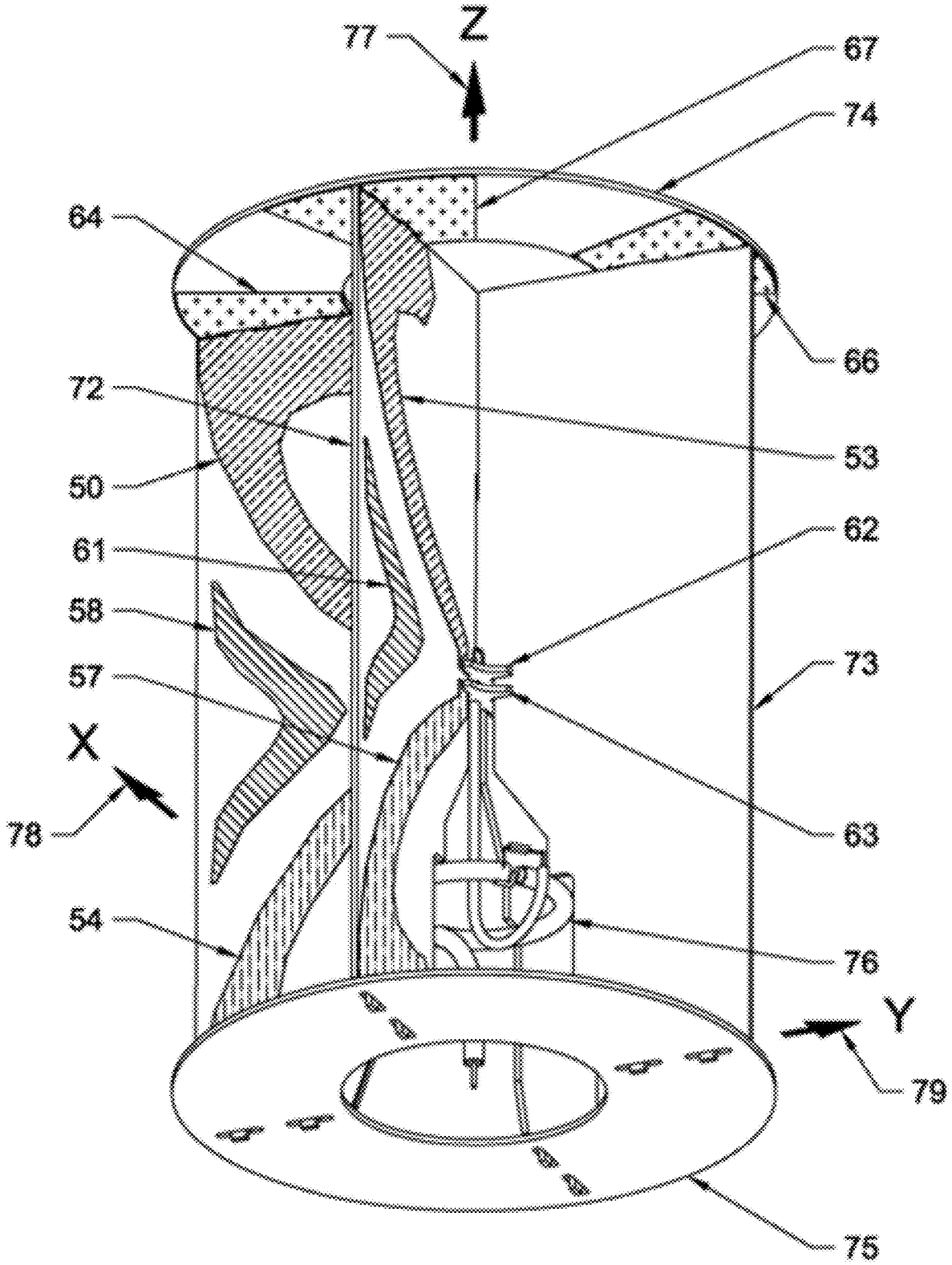
FIG. 7 illustrates another isometric of the broad band dipole antenna from a side perspective in accordance with an example embodiment.
Figure 8:
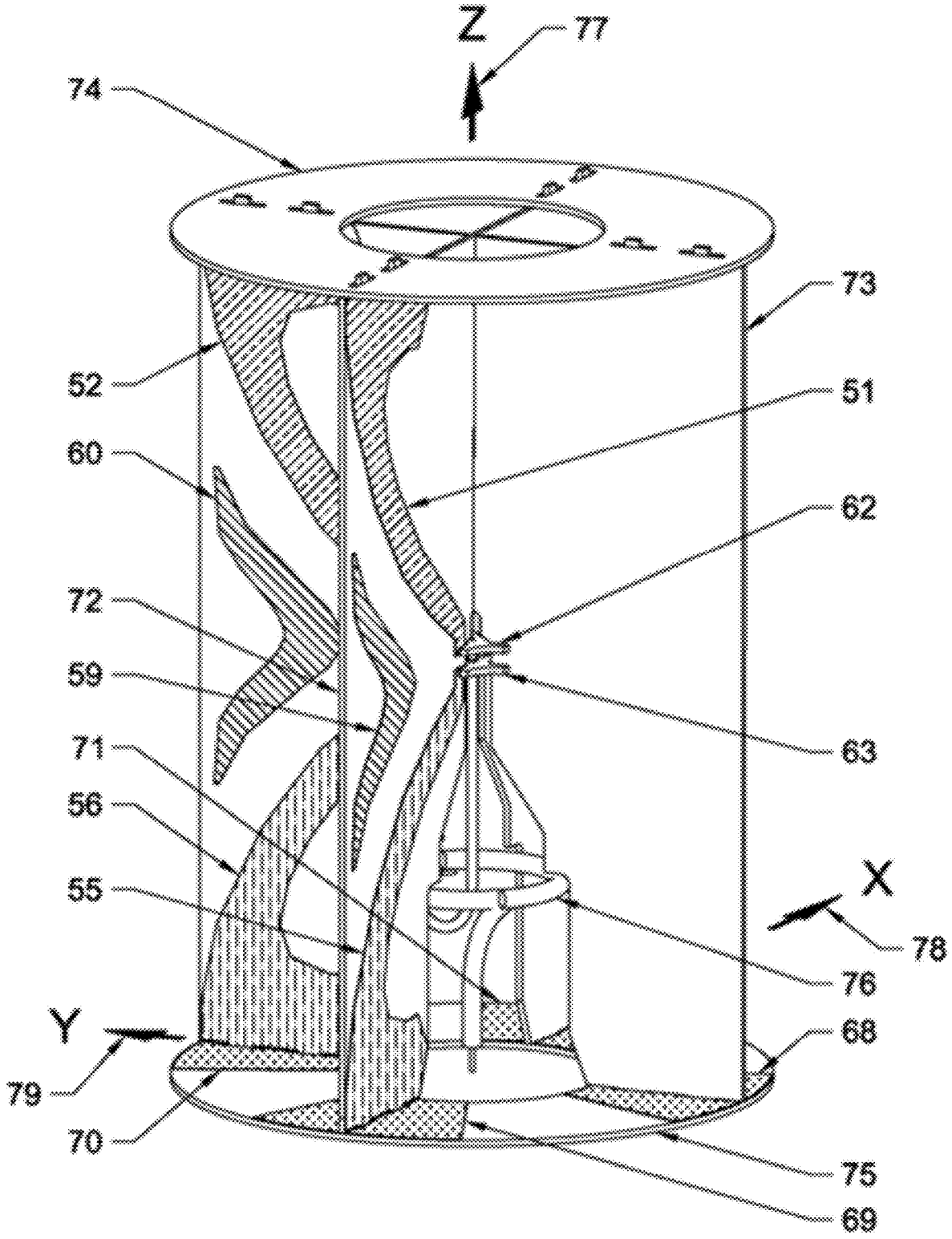
FIG. 8 illustrates another isometric of the broad band dipole antenna from a back perspective in accordance with an example embodiment.
Figure 9:
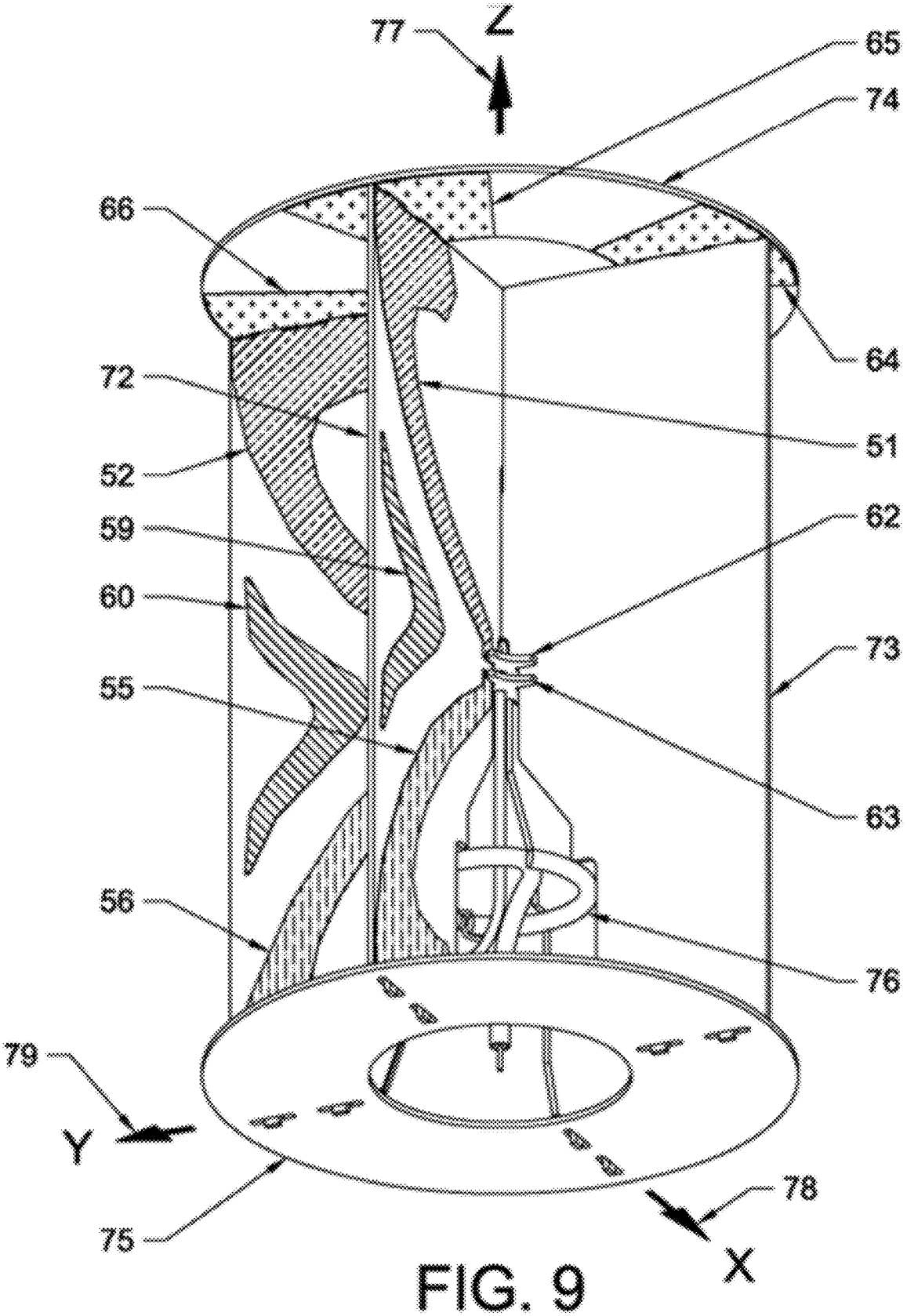
FIG. 9 illustrates an inclined front view of the broad band dipole antenna in accordance with an example embodiment.
Figure 10:
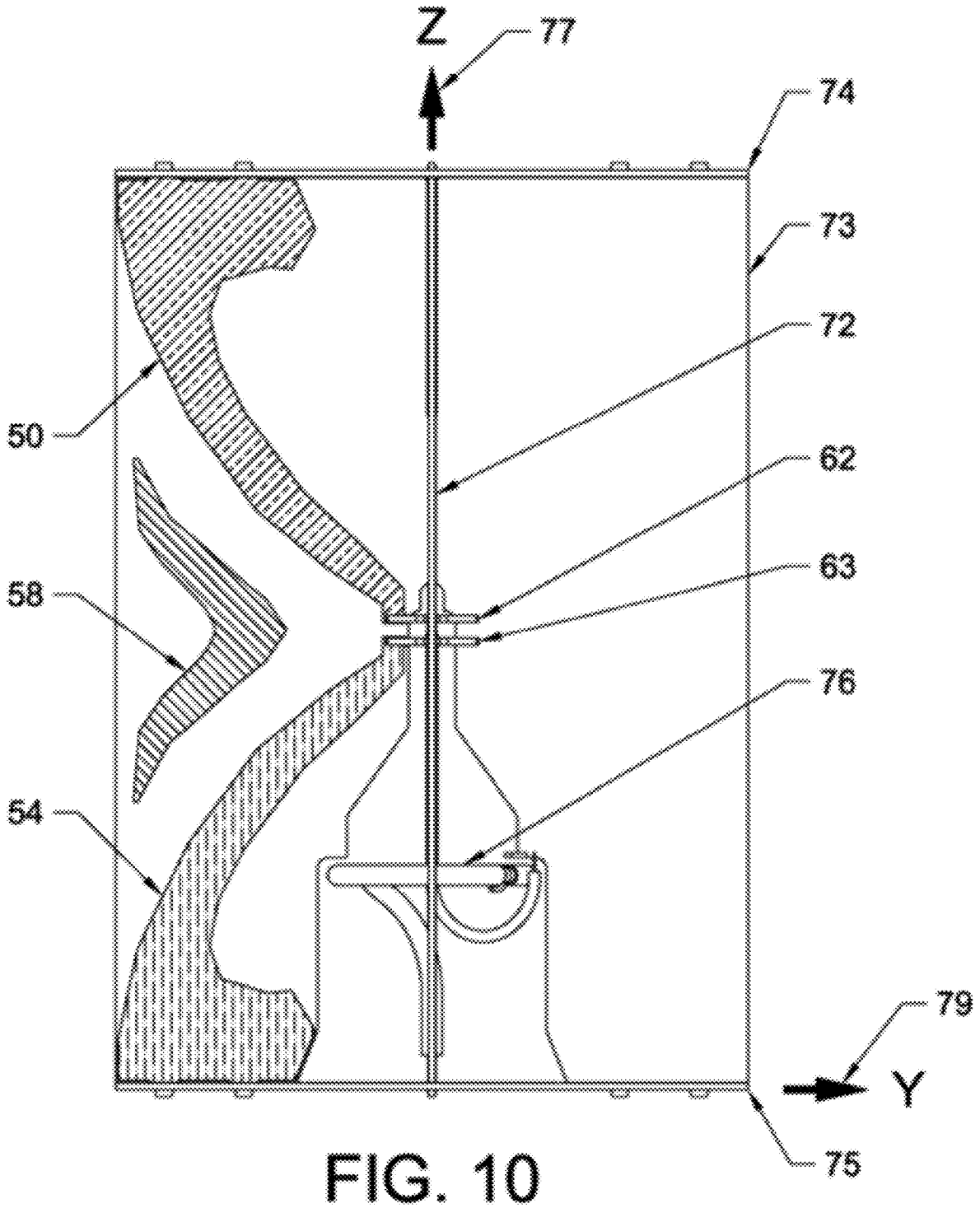
FIG. 10 illustrates a balun and jumpers employed in connection with the broad band dipole antenna from a back perspective in accordance with an example embodiment.
Figure 11:
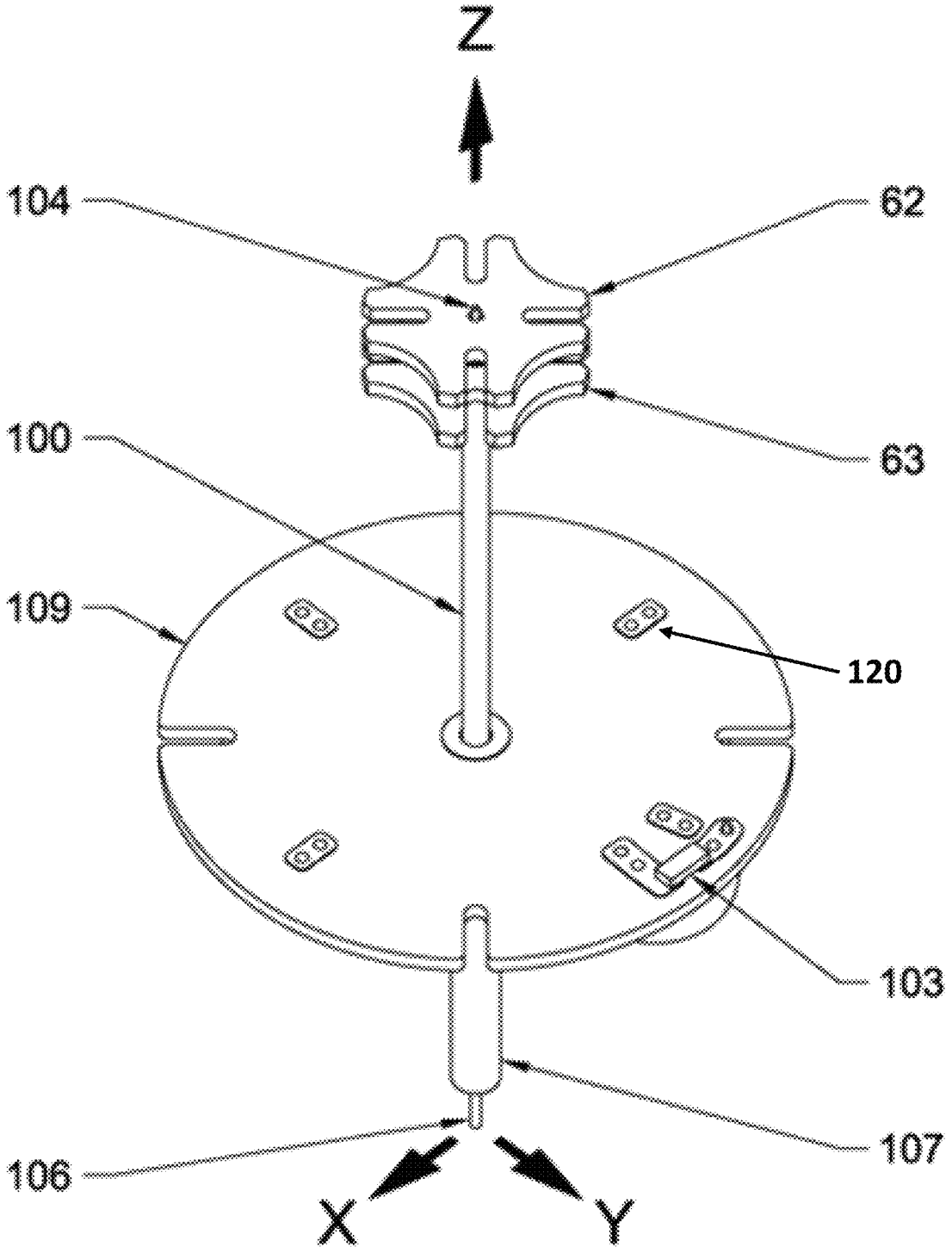
FIG. 11 illustrates a perspective view of a structure of the balun and jumpers of the broad band dipole antenna of FIGS. 6-10 in accordance with an example embodiment.
Figure 12:
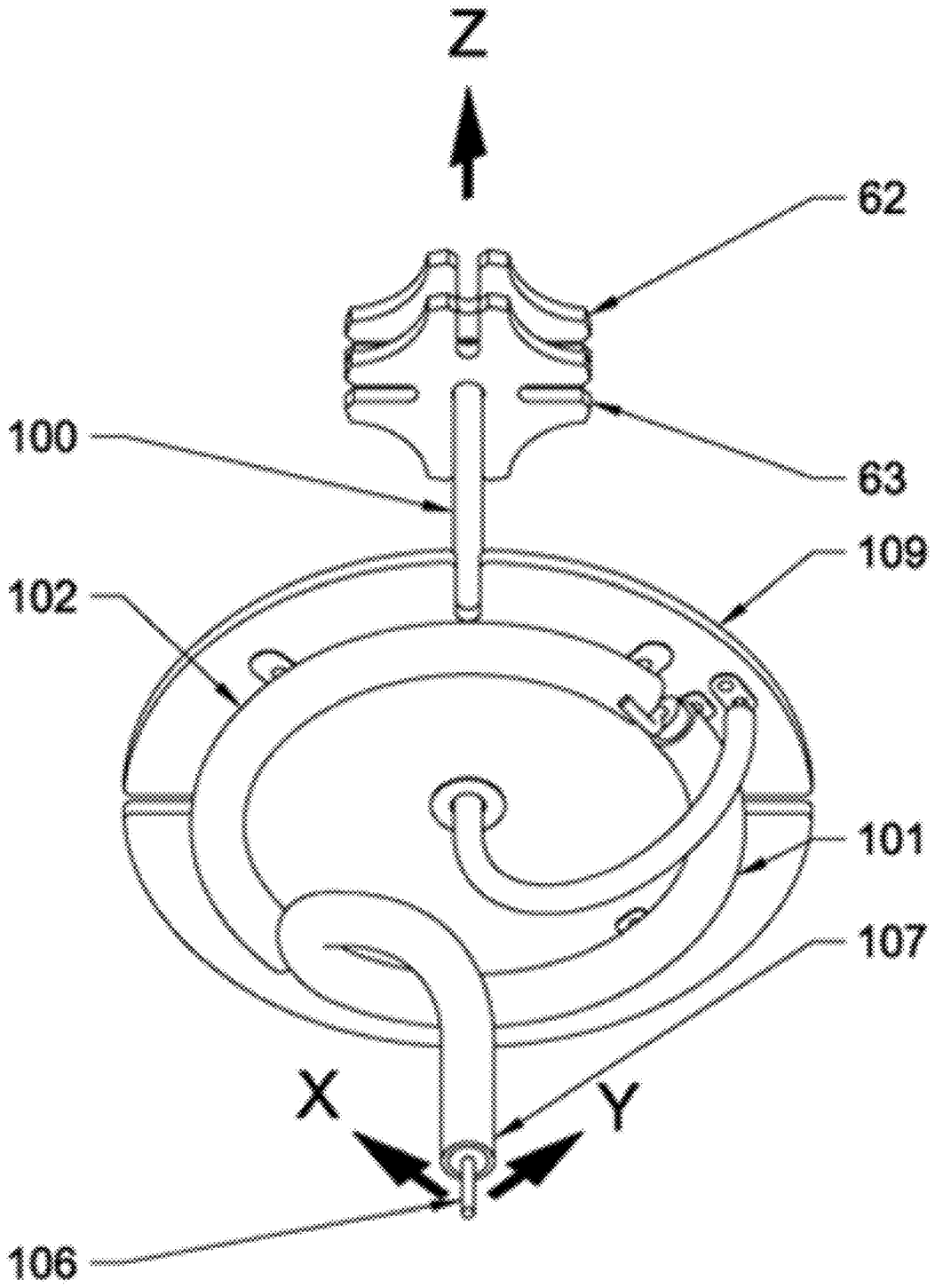
FIG. 12 illustrates an alternative perspective view of a structure of the balun and jumpers of the broad band dipole antenna of FIGS. 6-10 in accordance with an example embodiment.
Figure 13:
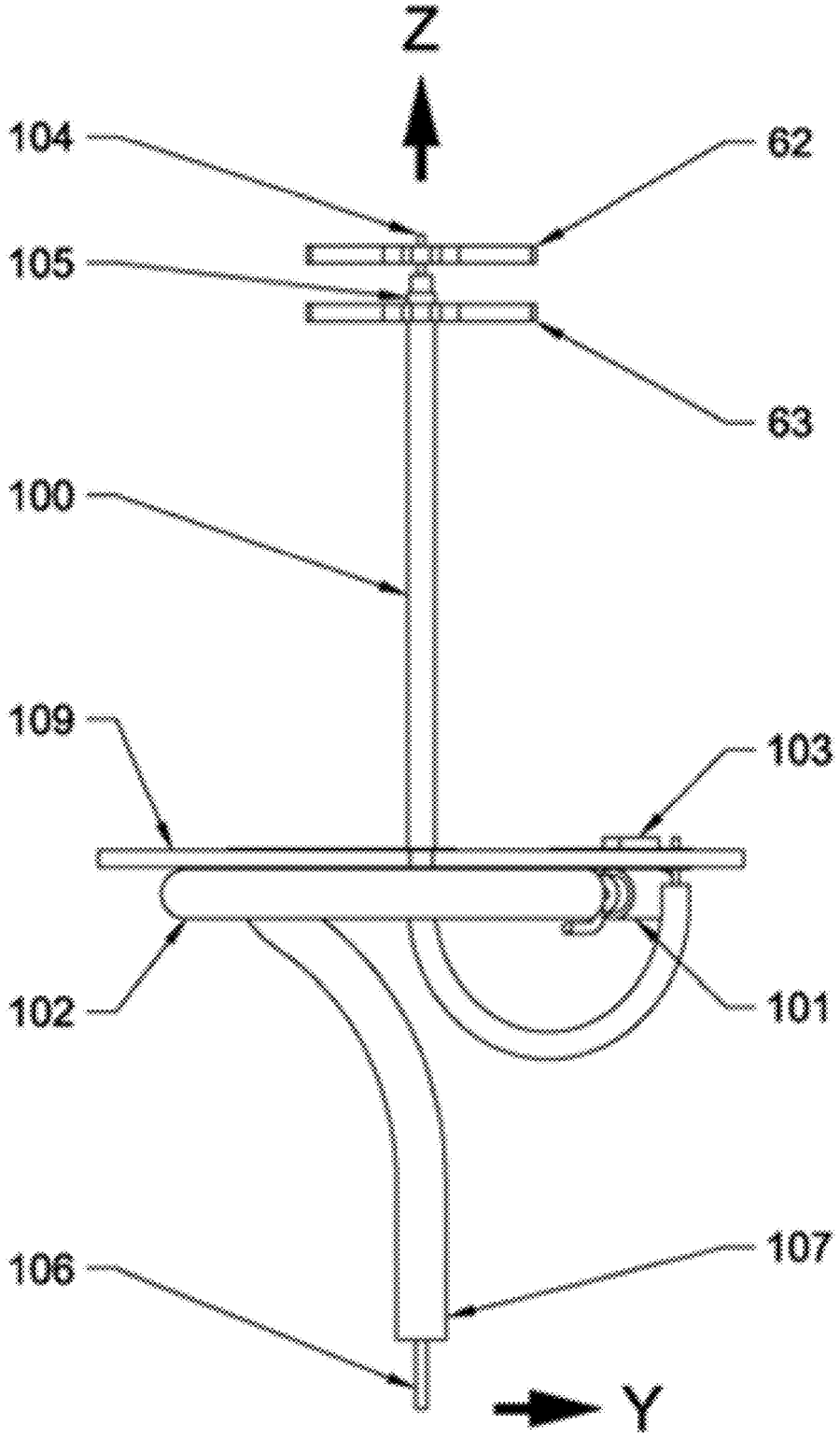
FIG. 13 illustrates a side view of a structure of the balun and jumpers of the broad band dipole antenna of FIGS. 6-10 in accordance with an example embodiment.

Accordingly, example embodiments may provide a complex structure that facilitated a small antenna, having broad bandwidth, with operation similar to a theoretical dipole but without the assistance of a ground plane. Referring now to FIGS. 6-13, a broad band dipole antenna of an example embodiment is shown. The broad band dipole antenna may include a first top radiator 50 which is a planar polygonal shaped surface arranged parallel to vertical axis 77 of the Broad band dipole antenna, and a first bottom radiator 54 which is a planar polygonal shaped surface arranged parallel to the first radiator and below of the first top radiator 50. The broad band dipole antenna may further include a first coupler 58 which is a planar polygonal shaped surface arranged in close proximity to both the first top radiator 50 and the first bottom radiator 54. The broad band dipole antenna may include a second top radiator 51, third top radiator 52, and fourth top radiator 53, each of which represents a copy of the first top radiator 50 which is rotated by 90°, 180° and 270° correspondingly around the vertical axis 77. The broad band dipole antenna may also include a second bottom radiator 55, third bottom radiator 56, and fourth bottom radiator 57, each of which represents a copy of the first bottom radiator 54 which is rotated by 90°, 180° and 270° correspondingly around the vertical axis 77. The broad band dipole antenna may also include a second coupler 59, third coupler 60 and fourth coupler 61, each of which represents a copy of the first coupler 58 which is rotated by 90°, 180° and 270° correspondingly around the vertical axis 77. The broad band dipole antenna may also include a first jumper 62 which connects bottom sides of the top radiators 50, 51, 52 and 53, and a second jumper 63 which connects top sides of the bottom radiators 54, 55, 56 and 57. The broad band dipole antenna may also include four flat perpendicular to vertical axes 77 capacitive elements 64, 65, 66 and 67, each of which is connected to the top to first top radiator 50 to second top radiator 51, to third top radiator 52, and to fourth top radiator 53 correspondingly. The broad band dipole antenna may also include four flat perpendicular to vertical axes 77 capacitive elements 68, 69, 70 and 71, each of which is connected to the bottom to first bottom radiator 54 to second bottom radiator 55, third bottom radiator 56, and fourth bottom radiator 57 correspondingly. The broad band dipole antenna may also include two parallel to vertical axis 77 and mutually perpendicular panels 72 and 73 made out of glass-reinforced epoxy laminate material FR-4 (or similar) and having an outer dimensions height 3.88 inches, width 2.7 inches and thickness 0.028 inch. In this regard, the first top radiator 50, the first bottom radiator 54 and the first coupler 58 may be located on one side of panel 73, thereto the third top radiator 52, the third bottom radiator 56 and the third coupler 60 are located on the second side of panel 73. The second top radiator 51, the second bottom radiator 55 and the second coupler 59 may be located on one side of panel 72, thereto the fourth top radiator 53, the fourth bottom radiator 57 and the fourth coupler 61 are located on the second side of panel 72. The broad band dipole antenna may also include two perpendicular to vertical axis 77 and mutually parallel circular panels 74 and 75 made out of glass-reinforced epoxy laminate material FR-4 (Or similar Material) and having an outer dimensions diameter 2.7 inches and thickness 0.028 inch. The capacitive elements 64, 65, 66 and 67 may be located on the bottom surface of the circular panel 74. The capacitive elements 68, 69, 70 and 71 may be located on the top surface of the circular panel 75. The broad band dipole antenna may also include Balun 76, which is located between the bottom radiators 54, 55, 56 and 57. First jumper 62 and second jumper 63 are connected to the first and second inputs of Balun 76 correspondingly. Two outputs of Balun are outputs of broad band dipole antenna. Jumper 62 and 63 are conductive in this design are volume copper-tin plated FR-4 laminate material. Within the figures, coordinate axes 77, 78 and 79 are given for orientation. FIGS. 6 and 7 show two panels 72 and 73 and two circular panels 74 and 75 made out glass-reinforced epoxy laminate material FR-4 are presented translucent.

In an example embodiment, the Balun 76 may include a coaxial semi rigid cable 100 which outer diameter is 0.047 inch and length is about 1.7 inch, a coaxial semi rigid cable 101 which outer diameter is 0.086 inch and length is about 2.5 inch, a coaxial semi rigid cable 102 which outer diameter is 0.086 inch and length is about 1.5 inch. The inner conductor of cable 102 is not in use. The Balun further includes capacitor 103, wherein inner conductor 104 and outer conductor 105 of the first side of the cable 100 represent the first and second input of Balun 76 correspondingly. Inner conductor 104 and outer conductor 105 are connected to the jumper 62 and jumper 63 correspondingly. Outer conductor of the second side of cable 100 is connected to the outer conductor of the first side of the cable 101. Inner conductor of the second side of cable 100 is connected to the first terminal of the capacitor 103. The second terminal of the capacitor 103 is connected to the outer conductor on the first side of cable 102 and inner conductor of the first side of cable 101. The outer conductor of the second side of cable 102 is connected to the point on outer conductor of the cable 101 which remote on 1.5 inch from the first side of cable 101. Inner conductor 106 and outer conductor 107 of the second side of the cable 101 represent: a) the first and second output of Balun 76 correspondingly, and b) the first and second output of Broad band dipole antenna correspondingly.

Figure 14:
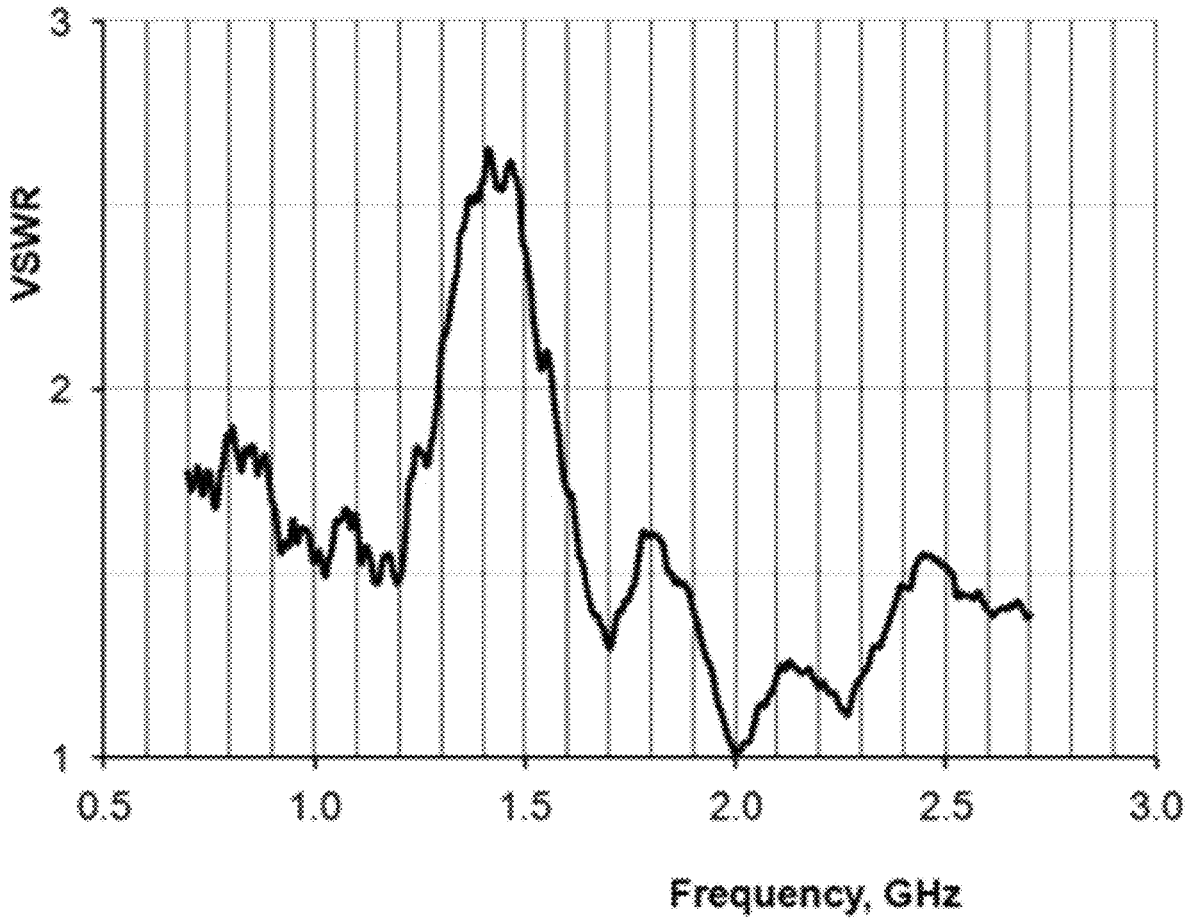
FIG. 14 illustrates a plot of voltage standing wave ratio (VSWR) of the broad band dipole antenna in accordance with an example embodiment.

VSWR of Broad band dipole antenna across the band is given on FIG. 14. VSWR in bandwidth ranges of 0.70-0.96 MHz and 1.71-2.70 GHz is below a value of 2. Accordingly, the complexity of the antenna structure facilitates control of the antenna to any frequency band, which is not possible with conventional antennas. Gain of the broad band dipole antenna at elevation 5° across azimuth at frequencies 0.70, 0.96, 1.71 and 2.7 GHz is given on FIG. 15 and FIG. 16. Omni directionality demonstrates the effect being able to suppress the currents on the antenna feed. Average gain close to the theoretical Dipole gain minus the reflected energy in FIG. 14.

Example embodiments, as depicted in details in FIGS. 6-13 show a number elements, including PCB 109 (FIGS. 11-13) and feed PCB connector 120 (FIG. 11), that facilitate the control of performance shown in FIGS. 14, 15 and 16 for controlling the shapes of polygons of top radiators 50, 51, 52 and 53, bottom radiators 54, 55, 56 and 57 combined with shape and proximity of the couplers 58, 59, 60 and 61 to top and bottom radiators 54-57 allows a complex optimization of the broad band dipole antenna of the present invention. The presence of an individual capacitive element 64-71 for each radiator (top radiators 50, 51, 52, 53 and bottom radiators 54, 55, 56 and 57) equalizes the current in the radiators, and that is equalizing gain in azimuths to achieve approximately the required Omni-Directional torus radiation. External cable 107 connected to broad band dipole antenna through Balun 76 feeds the external signal (from a radio) radiated by the broad band dipole antenna. This external cable is connected to Balun 76. Balun 76 of example embodiments is compact, occupies a small volume and is fitted with the dipole of the present invention. The Balun 76 isolates the broad band dipole antenna from the external cable 107 and facilitate the equal and balanced (opposite phase i.e. 180 degrees out of phase) excitation of the top and bottom radiator.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. A broad band dipole antenna comprising:

a first top radiator which is a planar polygonal shaped surface arranged parallel to a vertical axis of the broad band dipole antenna;

a first bottom radiator which is a planar polygonal shaped surface arranged parallel to the first top radiator and below the first top radiator;

a first coupler which is a planar polygonal shaped surface arranged in close proximity to both the first top radiator and the first bottom radiator;

N−1 top radiators where each next top radiator is a copy of the previous top radiator which is rotated by approximately 360°/N around the vertical axis, where N is an integer greater than one;

N−1 bottom radiators where each next bottom radiator is a copy of the previous bottom radiator which is rotated by approximately 360°/N around the vertical axis;

N−1 couplers where each next coupler is a copy of the previous coupler which is rotated by approximately 360°/N around the vertical axis;

a first jumper which connects the bottom sides of each top radiator; and a second jumper which connects the top sides of each bottom radiator, wherein the broad band dipole antenna further comprises 2N capacitive elements, where each of the 2N capacitive elements has a limited surface size, wherein a top side of each top radiator is connected to one of the capacitive elements, and wherein a bottom side of each bottom radiator is connected to one of the capacitive elements.

2. The broad band dipole antenna of claim 1, wherein feed PCB connectors connect all segments of the top radiators.

3. The broad band dipole antenna of claim 1, wherein feed PCB connectors connect all segments of the bottom radiators.

4. The broad band dipole antenna of claim 1, wherein feed PCB connectors connect all segments of the top and bottom radiators to a feed coax.

5. A broad band dipole antenna comprising:

a first top radiator which is a planar polygonal shaped surface arranged parallel to a vertical axis of the broad band dipole antenna;

a first bottom radiator which is a planar polygonal shaped surface arranged parallel to the first top radiator and below the first top radiator;

a first coupler which is a planar polygonal shaped surface arranged in close proximity to both the first top radiator and the first bottom radiator;

N−1 top radiators where each next top radiator is a copy of the previous top radiator which is rotated by approximately 360°/N around the vertical axis, where N is an integer greater than one;

N−1 bottom radiators where each next bottom radiator is a copy of the previous bottom radiator which is rotated by approximately 360°/N around the vertical axis;

N−1 couplers where each next coupler is a copy of the previous coupler which is rotated by approximately 360°/N around the vertical axis;

a first jumper which connects the bottom sides of each top radiator; and a second jumper which connects the top sides of each bottom radiator, wherein the broad band dipole antenna further comprises a Balun assembly located between N bottom radiators, wherein the first jumper and the second jumper are connected to corresponding first and second inputs of the Balun assembly, and wherein two outputs of the Balun are outputs of the broad band dipole antenna.

6. The broad band dipole antenna of claim 5, wherein feed PCB connectors connect all segments of the top radiators.

7. The broad band dipole antenna of claim 5, wherein feed PCB connectors connect all segments of the bottom radiators.

8. The broad band dipole antenna of claim 5, wherein feed PCB connectors connect all segments of the top and bottom radiators to a feed coax.

* * * * *